US005496020A

United States Patent [19]

Takemoto et al.

[11] Patent Number: 5,496,020

[45] Date of Patent: Mar. 5, 1996

[54] BANK NOTE TRANSPORTING APPARATUS IN GAME MACHINE ISLAND

[75] Inventors: Takatoshi Takemoto; Toshikazu Chida, both of Tokyo; Noriaki Kano, Hanamaki; Eiji Ito, Hanamaki; Koji Murakami, Hanamaki; Takashi Itagaki, Hanamaki; Kozo Sekimoto, Sendai; Masanori Suzuki, Hanamaki, all of Japan

[73] Assignee: Kabushiki Kaisha Ace Denken, Tokyo, Japan

[21] Appl. No.: 240,710

[22] PCT Filed: Nov. 7, 1991

[86] PCT No.: PCT/JP92/01440

§ 371 Date: May 9, 1994

§ 102(e) Date: May 9, 1994

[87] PCT Pub. No.: WO93/09517

PCT Pub. Date: May 13, 1993

[30] Foreign Application Priority Data

Nov. 7, 1991 [JP] Japan ..... 3-291576

[51] Int. Cl.[6] ..... B65H 3/44

[52] U.S. Cl. ..... 271/9.01; 271/9.13; 271/258.01; 271/265.01; 271/266; 271/176

[58] Field of Search ..... 271/9, 258, 259, 271/265, 266, 272, 273, 69, 176, 9.01, 9.13, 258.01, 265.01

[56] References Cited

U.S. PATENT DOCUMENTS

| | | |
|---|---|---|
| 4,988,849 | 1/1991 | Sasaki et al. . |
| 5,158,274 | 10/1992 | Hamada et al. . |

FOREIGN PATENT DOCUMENTS

| | | | |
|---|---|---|---|
| 0133819A1 | 3/1985 | European Pat. Off. . | |
| 0146290A3 | 6/1985 | European Pat. Off. . | |
| 0194139A3 | 9/1986 | European Pat. Off. . | |
| 0233561A3 | 8/1987 | European Pat. Off. . | |
| 61-124473 | 6/1986 | Japan . | |
| 1127539 | 5/1989 | Japan | 271/9 |
| 2-18237 | 1/1990 | Japan . | |
| 2169431 | 6/1990 | Japan | 271/9 |
| 2-243440 | 9/1990 | Japan . | |
| WO92/20600 | 11/1992 | Japan . | |
| 2139390A | 11/1994 | United Kingdom . | |

*Primary Examiner*—David H. Bollinger
*Attorney, Agent, or Firm*—Lowe, Price, LeBlanc & Becker

[57] ABSTRACT

A bank note transporting apparatus for transporting externally inserted bank notes is provided in an game machine island in which a plurality of game machines (12) and a plurality of game media lending machines (13) for lending game media used for playing games are disposed. The bank note transporting apparatus comprises a main transporting path (200) provided within the island for transporting bank notes to a destination position and an introducing path (300) disposed in at least one position along the length of the main transporting path for merging bank notes externally inserted into the island to the main transporting path. The main transporting path including an accepting slot (3) for accepting the bank notes from the introducing path. The introducing path including a bank note inserting unit (4) into which the bank notes are externally, inserted and a merging unit (9*a*) for guiding and transporting the inserted bank notes to the accepting slot. The merging unit including a passage member (6) for transporting the bank notes and a passage frame (9) which is pivotally mounted on one end of the passage member.

16 Claims, 10 Drawing Sheets

BANK NOTE TRANSPORTING APPARATUS IN GAME MACHINE ISLAND

FIELD OF THE INVENTION

The present invention relates to a bank note transporting apparatus in a game machine island in which bank notes inserted into a bank note inserting slot as a game playing fee can be supplied to a bank note transporting path in a position along the length thereof via a bank note identifying machine and can be transported from one side to the other side of the path.

BACKGROUND OF THE RELATED ART

A plurality of game machine rows (hereinafter referred to as "game machine island") comprising a plurality of game machines and a plurality of game media lending machines for lending game media which are used for playing games by game players are disposed in game parlors. When a game player plays a game, he or she rents game media by inserting bank notes into a game media lending machine as a game playing fee. The bank notes which were inserted into the game media lending machine are accepted into the island and are then collected to a destination position, such as one end of the island. As a means thereof, a bank note transporting apparatus is provided in the island.

The bank note transporting apparatus includes a unit for merging the bank notes which are inserted from the game media lending machine. Such a type of mechanism is incorporated in the transporting apparatus and per se is not easily disassembled.

Jamming of the bank notes in the bank note merging unit is liable to occur due to the complicated structure and inappropriate timing of merging of the bank notes, etc. In the event of jamming of the bank notes, the game media lending machine is unable to be used and game players are considerably inconvenienced.

The inside of a conventional bank note transporting apparatus, including the bank note merging unit is not easily accessible. In the event of jamming or other failures, it takes an extended period of time to conduct repair service such as removal of the jammed bank notes.

SUMMARY OF THE INVENTION

It is a principal object of the present invention to provide a bank note conveying apparatus in which a unit for merging bank notes to a main transporting path can be easily opened to rapidly deal with jamming or failure therein.

In order to accomplish the above mentioned object, in one aspect of the present invention, there is provided a bank note transporting apparatus for transporting externally inserted bank notes, which is provided in a game machine island in which a plurality of game machines and a plurality of game media lending machines for lending game media used for playing games are disposed, the bank note transporting apparatus comprising a main transporting means provided within the island for transporting bank notes to a destination position; and an introducing means disposed in at least one position along the length of the main transporting path for merging bank notes externally inserted into the island to the main transporting means;

the main transporting means including an accepting slot for accepting the bank notes from the introducing means;

the introducing means including a bank note inserting unit into which the bank notes are externally inserted and a merging unit for guiding and transporting the inserted bank notes to the accepting slot;

the merging unit including a passage member for transporting the bank notes and a passage frame which is pivotally mounted on one end of the passage member and;

the passage frame being mounted on the passage member in such a manner that the passage frame is disposed in parallel with the passage member to form a transporting passage therebetween when the introducing means is driven and is separated from the transporting passage defining face of the transporting member when the passage frame is pivoted.

The main transporting means, which may be considered to be structure providing a pathway or path, may include a transporting belt for transporting bank notes, a guide for guiding the transported bank notes and a transporting belt which forms a transporting path between it and a guide for transporting the bank notes along the guide. The guide may have the accepting slot. The accepting slot may be wider than the lateral width of the transporting belt.

The merging unit may include guide strips, at the front ends of the passage member and the passage frame, for guiding bank notes to an accepting slot of the main transporting path.

The passage frame may include a pivot shaft provided in the vicinity of the base end portions of the guide strips so that the passage frame is pivotally linked with the passage member via the pivot shaft.

The guide strips may have respective front ends which are inserted into the accepting slot.

The guide strips may be disposed so that they are slanted toward the guide.

The guide strips may be provided on the passage member and on the passage frame. They may have such a positional and dimensional relationship that they do not structurally interfere with each other when the passage frame is pivoted. For example, two guide strips on the side of the passage frame are provided with a spacing which is larger than the width of the transporting belt and the guide strip on the passage member are provided in such a positional and dimensional relationship with the guide strips on the passage frame that the former guide strip can be sandwiched between the latter two guide strips.

The transporting belt 2 may transport the bank notes which are in an erected position.

The transporting path may further include a bank note identifying unit between the bank note inserting unit and the merging unit for determining whether the bank note is genuine or fake.

The merging unit may include transporting members for transporting bank notes and a drive source for driving the transporting members. In such an arrangement, the merging unit accepts the bank notes from the bank note identifying unit for feeding them to the main transporting path via the accepting slot.

The drive source may comprise a motor for driving the transporting members, a control unit for controlling energizing of the motor and a sensor for detecting the presence or absence of a bank note in the vicinity of the front of the accepting slot where merging unit is disposed.

The control unit is adapted to temporarily stop the bank note when the bank note is accepted from the bank note identifying unit and to feed out the bank note via the accepting slot when the sensor detects that no bank note is transported in the vicinity of the front of the accepting slot.

In accordance with the present invention, the merging unit can be opened by pivoting the passage frame around the pivot shaft if a bank note or notes are jammed in the merging unit. Accordingly, the inside of the standby transporting passage and the front end side can be widely opened toward the front side, so that removal of jammed bank notes or repair of the inside can be quickly and easily carried out.

DETAILED DESCRIPTION OF THE PREFERRED EMBODIMENTS

Various embodiments of the present invention will now be described with reference to the drawings.

Figure 10:
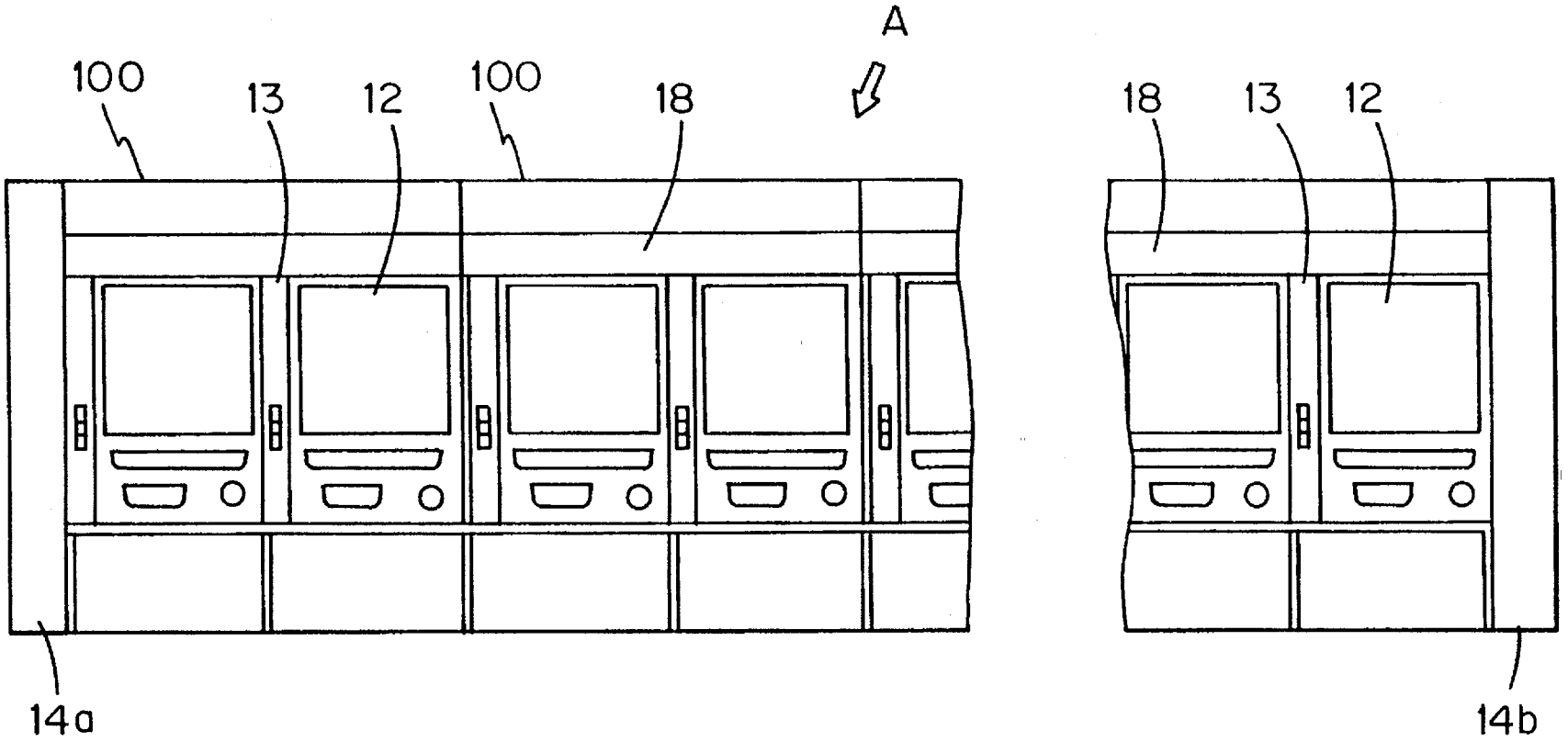
FIG. 10 is a front view showing the structure of the game machine island.

A bank note transporting apparatus of the first preferred embodiment is mounted within a game machine island which is shown in FIG. 10 and is adapted to transport bank notes which were paid by game players for playing games.

The game machine island A which is shown in FIG. 10 comprises game machines 12 and game media lending machines 13 which are alternately disposed in a row. Since the game machines 12 and the game media lending machines 13 are grouped and arrayed into "islands" in a game parlor, they are referred to as "islands". One game machine island comprises two rows of the game machines 12 and game media lending machines 13 (hereinafter referred to as "game machine row") which are disposed on the opposite sides of the row with the back facing each other. FIG. 10 shows one of the two rows as viewed from the front side thereof.

The game machines 12 include, for example, slot machines. The game media lending machines 13 are to lend game media which are used in playing games. The game media include, for example, medals, balls and the like.

End members 14*a* and 14*b* which are referred to as "island decoration" are mounted on the opposite ends of a game machine row to cover them. The game machine island includes a plurality of unit supporting frames 100 which constitute the skeleton for the structure of the island. One unit supporting frame 100 is arranged to support two sets of game machines 12 and game media lending machines 13. A plurality of unit supporting frames 100 are continuously arranged to form one game machine island.

The unit supporting frame 100 includes a supporting plate 15 which is located on the game machine 12 and the game media lending machine 13 and a covering member 18 on the supporting plate, which is referred to as a "screen plate".

Figure 9:
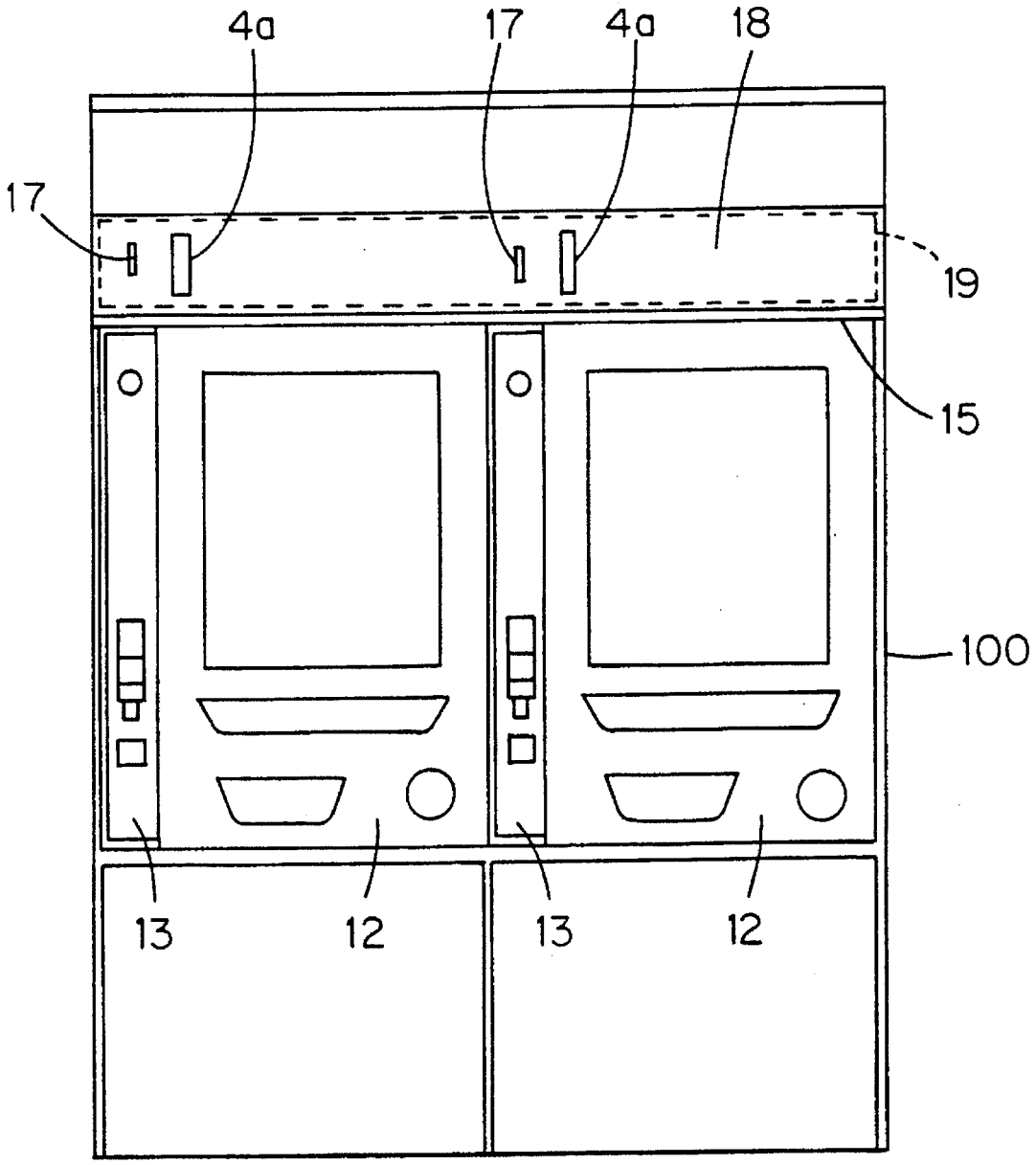
FIG. 9 is a front view showing one unit of the game machine islands.

The screen plate 18 is provided with bill or bank note inserting slots 4*a* and coin inserting slots 17, each for one game media lending machine 13 as shown in FIG. 9. FIG. 9 shows one unit comprising two game machines 12 and two game media lending machine 13.

Figure 5:
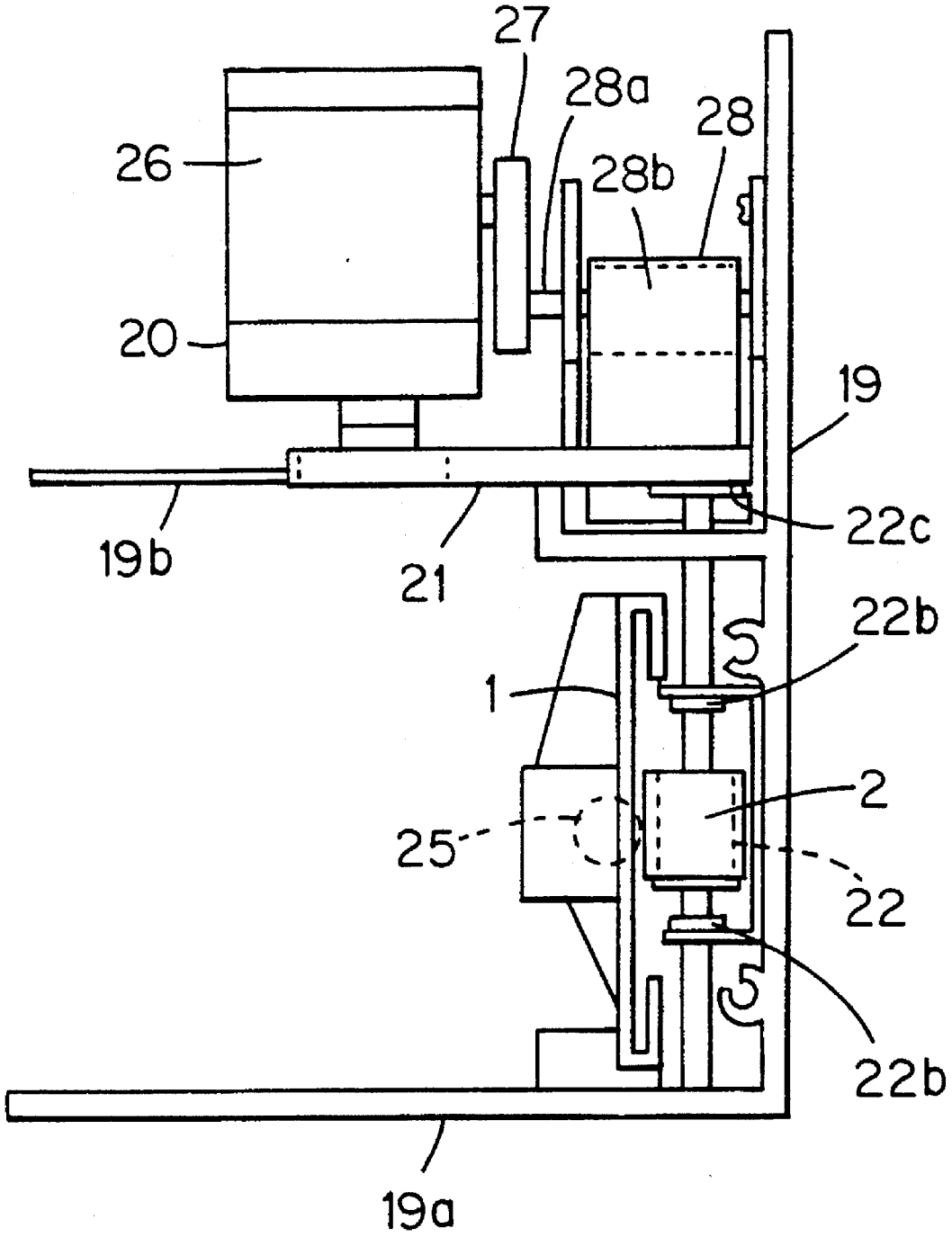
FIG. 5 is an lateral view showing the structure of the main transporting path and the coin transporting path used in the present embodiment.

A board 19 having a dimension for one unit is secured to the supporting plate 15. The board 19 is covered with a covering member 18 on the front side thereof so that it is concealed from game players. The board 19 includes a bottom plate 19*a* and an upper plate 19*b* as shown in FIG. 5. These plates are provided perpendicularly relative to the board 19.

Figure 8:
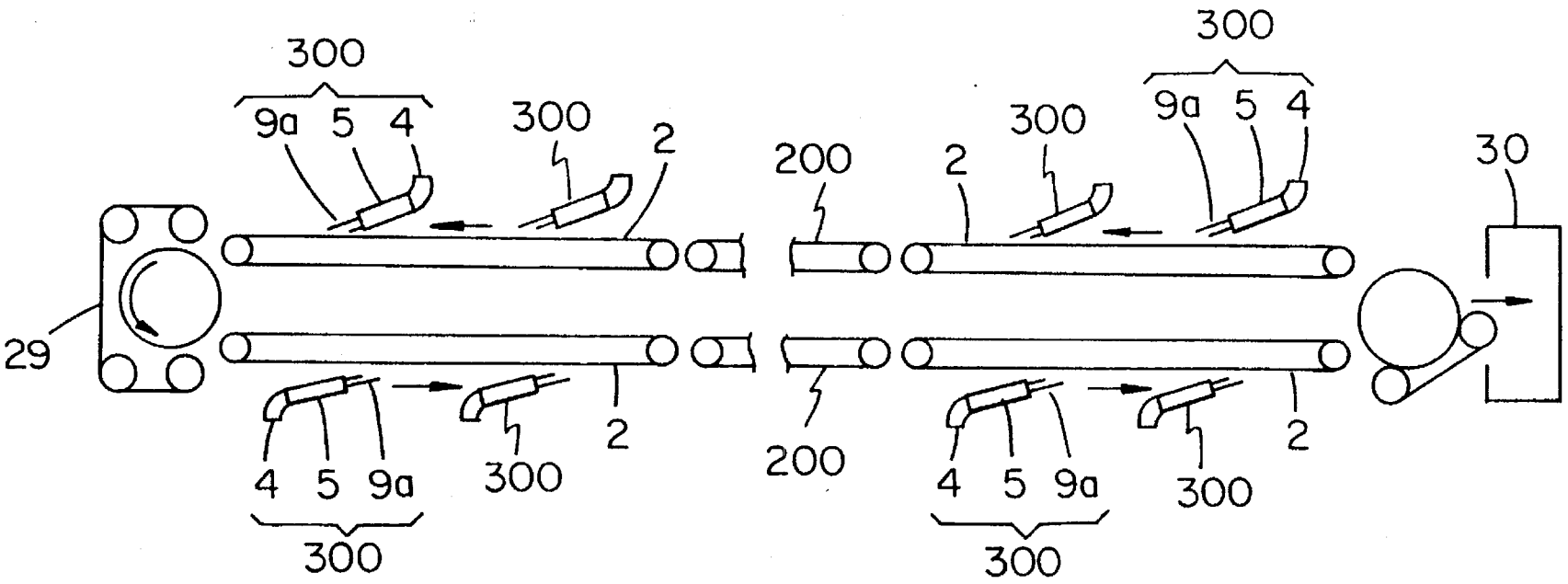
FIG. 8 is a plan view showing the outline of the structure of the bank note transporting apparatus of the present embodiment, which is disposed in the game machine island.

As shown in FIG. 8, the bank note transporting apparatus of the present embodiment comprises main transporting paths 200 each for one game machine row for transporting bank notes, guiding paths 300 for accepting bank notes which are externally inserted into the bank note inserting slots 4*a* and for merging the bank notes into the main transporting paths after identifying whether they are genuine or fake, and a transferring device 29 for transferring bank notes from the rear end of one upstream main transporting path 200 to the front end of the other downstream main transporting path 200. In the present embodiment, a stacker 30 for accommodating transported bank notes is disposed at the rear end of the downstream main transporting path. The stacker 30 is provided for, for example, a bill change machine. The transferring device 29 and the stacker 30 are disposed in the end members 14*a* and 14*b*, respectively.

The main transporting paths 200 comprise a plurality of belts 2 which are successively disposed. Each of the belts 2 is provided for one unit. Each introducing path 300 is provided for one game media lending machine 13. Two introducing paths 300 are provided for each transporting belt 2. The introducing path 300 includes a bank note inserting unit 4 having the bank note inserting slot 4*a* and a bank note identifying unit 5 for identifying whether the inserted bank notes are genuine or fake and a merging unit 9*a* for merging the bank notes into the main transporting paths 200. The structure of the introducing path 300 will be hereinafter described in detail.

The transporting belt 2 is tensioned between a gear type drive wheel 22 which is provided at one end thereof and a gear type idle wheel 23 which is provided at the other end thereof. A plurality of gear type supporting wheels 24 which bear the belt 2 are equally spacedly disposed between the drive and idle wheels 22 and 23.

A guide 1 is provided on the outer side of one face of the transporting belt 2 to form a bank note transporting passage between the transporting belt 2 and the guide 1. The guide 1 is provided with balls 25 in positions corresponding to the drive wheel 22, the idle wheel 23 and the supporting wheel 24 for biasing the bank notes upon the belt 2.

The balls 25 are provided so that they are rotatably in contact with the belt 2. The balls 25 are disposed in the positional relationship with the drive wheel 22, the idle wheel 23 and the supporting wheel 24 as shown, for example, in FIG. 5. Accordingly, the bank notes are sandwiched between the belts 2 and the balls 25 and are transported by and together with the movement of the belt 2. The friction of the balls is low since they rotate at this time. Resistance to the transportation of the bank note is negligible. The balls may be replaced with rollers.

Figure 7:
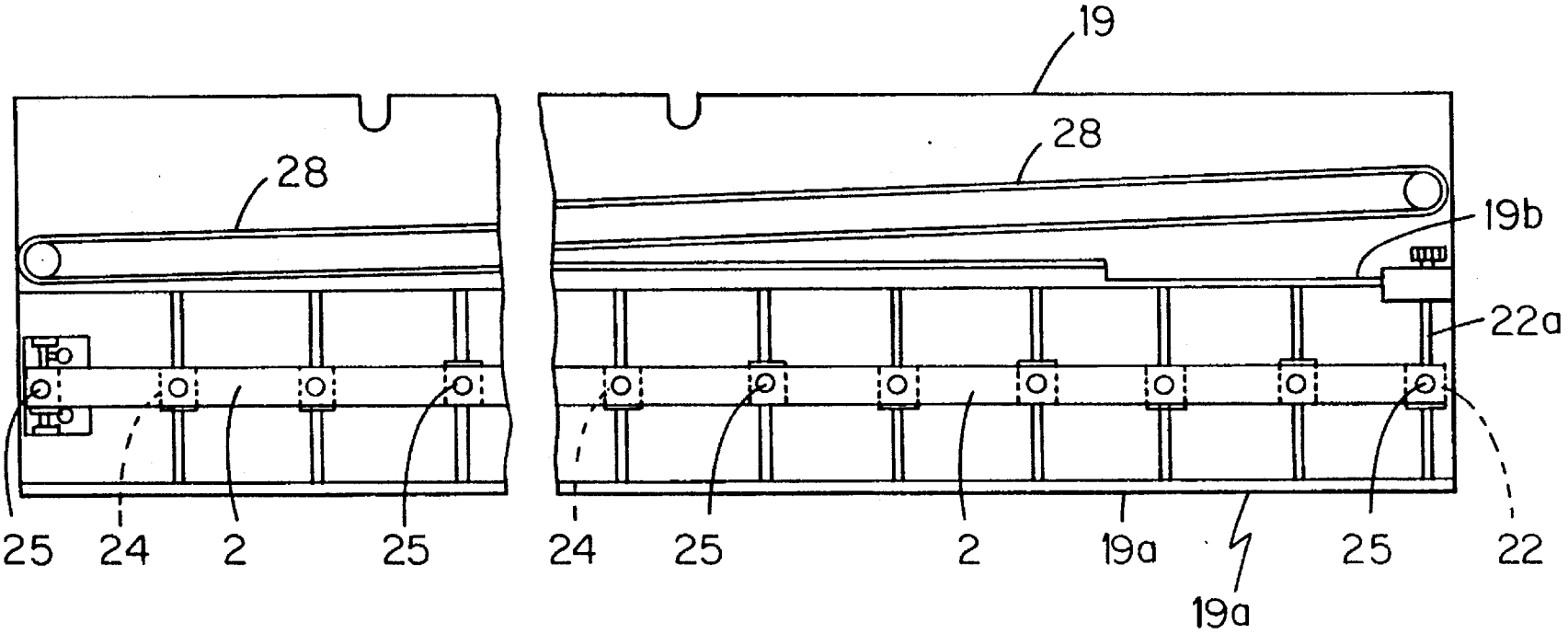
FIG. 7 is a rear view showing the entire of the main transporting path and the coin transporting path used in the present embodiment, part of which is omitted.

The transporting belt 2 is disposed above the bottom plate 19*a* of the board 19 as will be described hereafter. In the present embodiment, the rotary shafts of the drive wheel 22, the idle wheel 23 and the supporting wheel 24 are arranged in a substantially vertical direction as shown in FIG. 7. This enables the bank notes to be transported in an erected position. The transporting belt 2 is provided with the merging unit 9*a* of the above mentioned introducing paths 300 in two positions along the length thereof.

Figure 2:
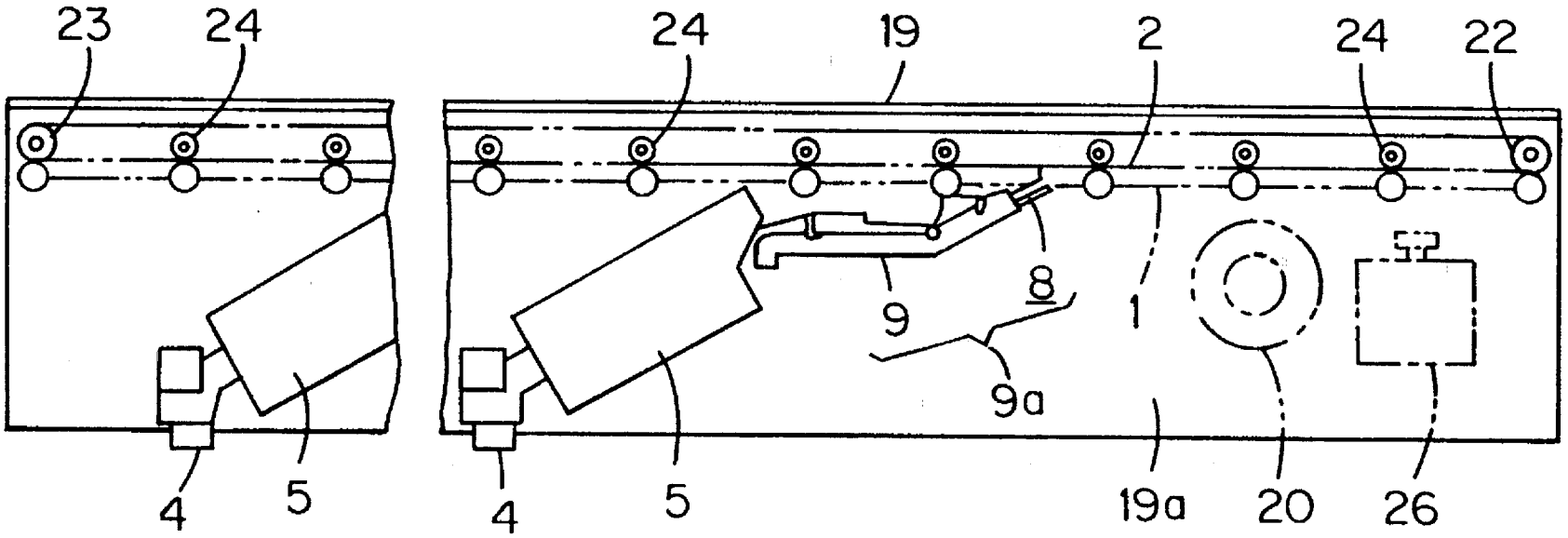
FIG. 2 is a partial plan view showing the structure of one unit of the main transporting path of the bank note transporting apparatus of the embodiment of the present invention.

In FIG. 2, a reference 20 denotes a motor for driving the drive wheel 22 and a reference 26 denotes a motor for driving a coin transporting belt which will be described hereafter.

An example of the coin transporting belt is shown in FIG. 7. The coin transporting belt 28 in FIG. 7 is disposed above the upper plate 19*b* of the board 19. The coin transporting belt 28 is slanted so that its front and rear ends are lower and higher in elevation, respectively.

Figure 6:
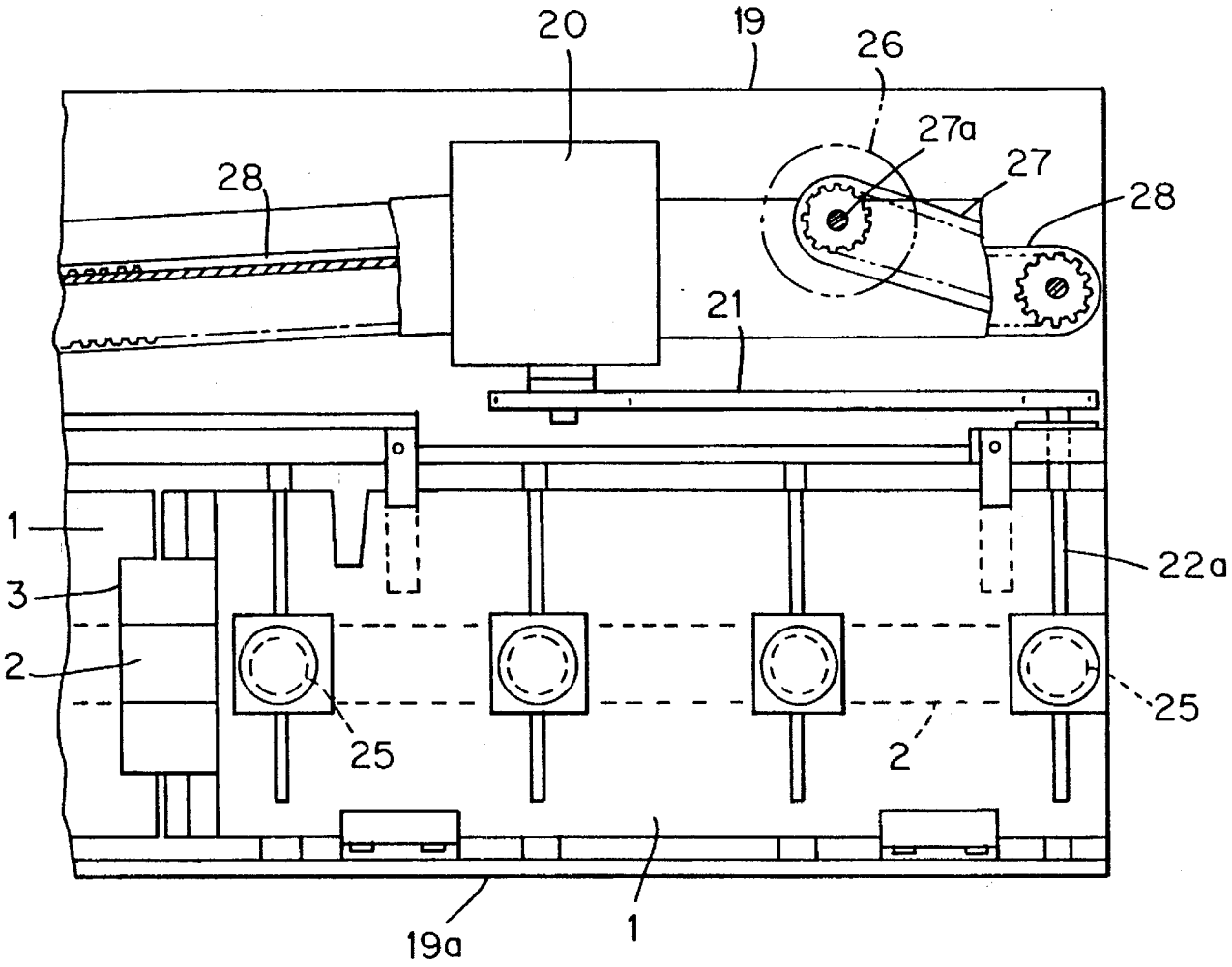
FIG. 6 is a rear view showing the main transporting path and the coin transporting path shown in FIG. 5 as viewed from the rear side thereof.

The motors 20 and 26 are disposed above the upper plate 19*b* as shown in FIGS. 5 and 6.

The motor 20 drives the rotary shaft 22*a* of the drive wheel 22 to rotate via a pulley 21*a*, a timing belt 21 and a pulley 22*c*. The rotary shaft 22*a* is provided vertically relative to and between the bottom plate 19*a* and the upper plate 19*b* and is rotatably journalled by a bearing 22*b*. The bearing 22*b* is secured to the board 19.

The motor 26 drives the drive shaft 28*a* to rotate it via a pulley 27*a* and a timing belt 27. Since the drive wheel 28*b* is connected with the drive shaft 28*a*, the belt is driven by the motor 28.

In FIG. 5, the guide 1 has such a height that it is capable of guiding the bank notes which are in an erected position and is grooved at the upper and lower portions thereof. These grooves enable the bank notes to be transported without being bent.

As shown in FIG. 6, the guide 1 is provided with an accepting slot 3 at the front end of the merging unit 9*a*. The accepting slot 3 has an opening having such a dimension that the front end of the merging unit 9*a* will not be brought into contact with the belt when it is swung. The accepting slot 3 has an opening length which is larger than the width of the belt 2.

Now, the introducing path 300 will be described with reference to FIGS. 1, 3, 4 and 6.

Figure 3:
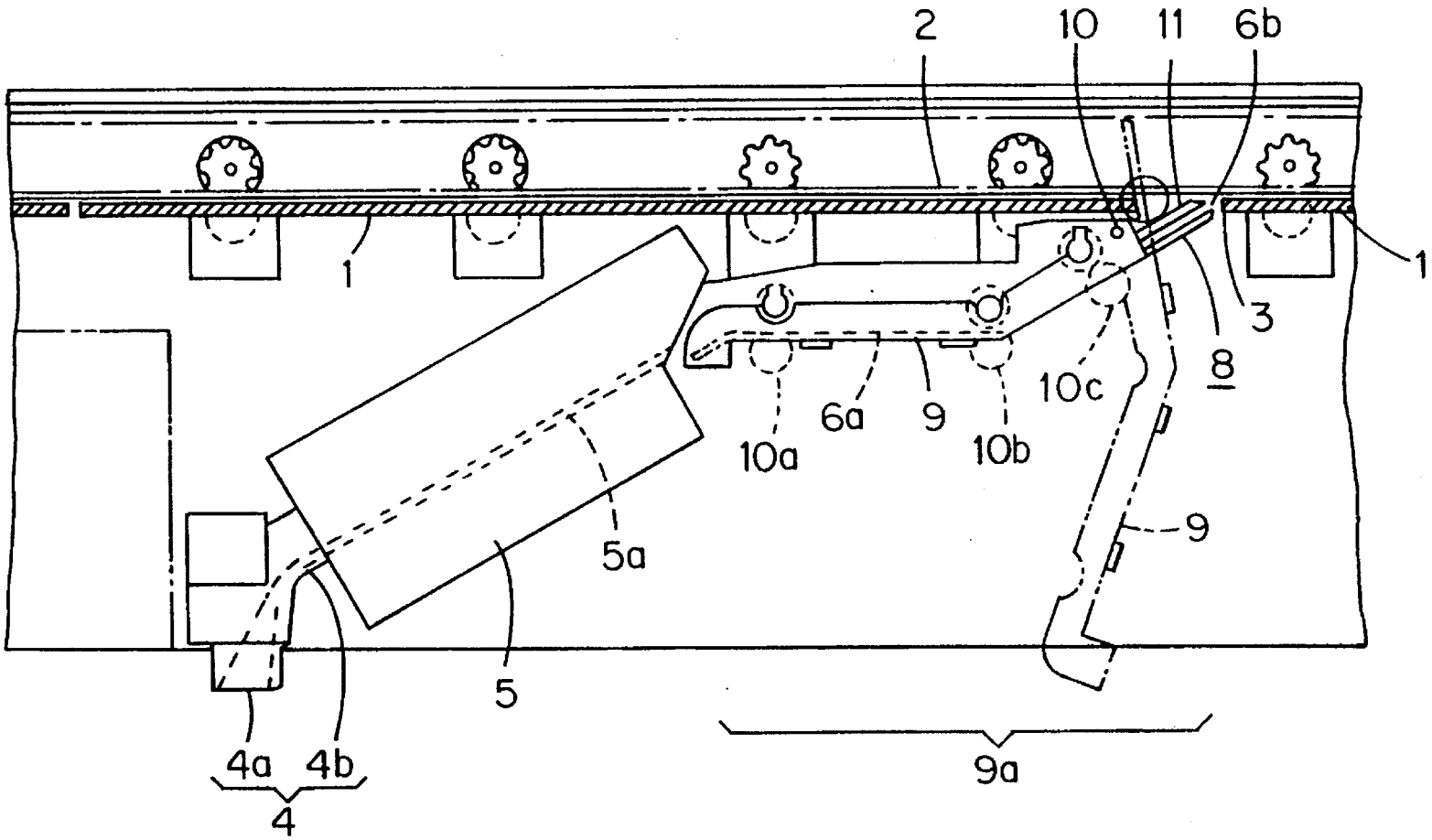
FIG. 3 is a partial cutaway plan view showing the structure of the introducing path of the bank note transporting apparatus of the embodiment of the present invention.

The outline of the introducing path 300 is illustrated in FIG. 3. The introducing path 300 comprises the bank note inserting unit 4, the bank note identifying unit 5 and the merging unit 9*a*.

The bank note inserting unit 4 comprises a bank note inserting slot 4*a* and the guiding unit 4*b* for curving the bank note inserted into the slot 4 in a slanted direction.

The bank note identifying unit 5 is slanted relative to the transporting belt 2 so that it gradually approaches to it. The bank note identifying unit 5 includes therein a transporting mechanism for transporting the bank notes (not shown), sensors for detecting the bank note (not shown) and a determining unit for processing detection information from the sensors to determine whether the bank note is genuine or fake (not shown). The unit 5 is also provided with a passage 5*a* for transporting the bank notes.

Figure 1:
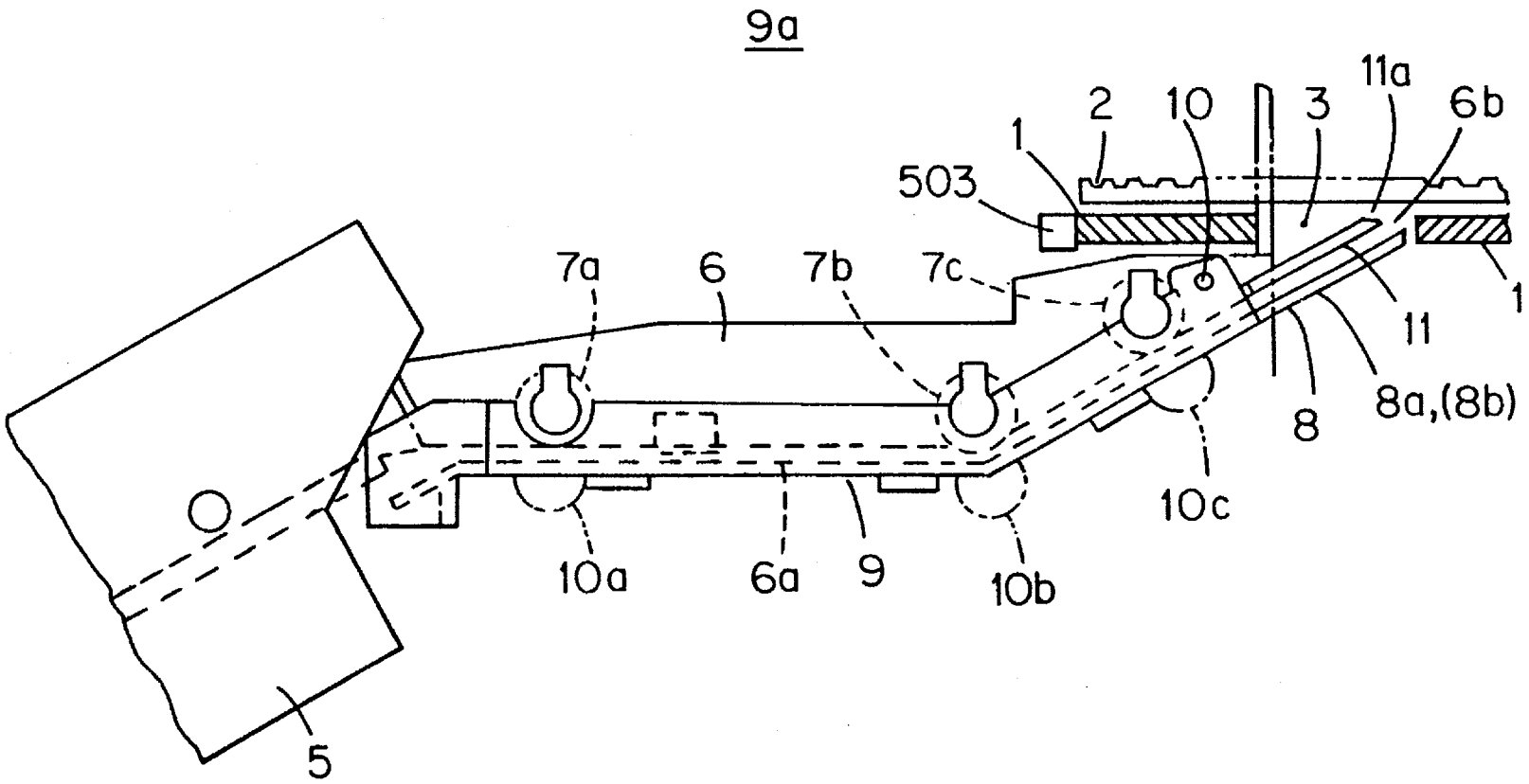
FIG. 1 is a partial cutaway plan view showing the structure of the merging unit of the bank note transporting apparatus of one embodiment of the present invention.
Figure 4:
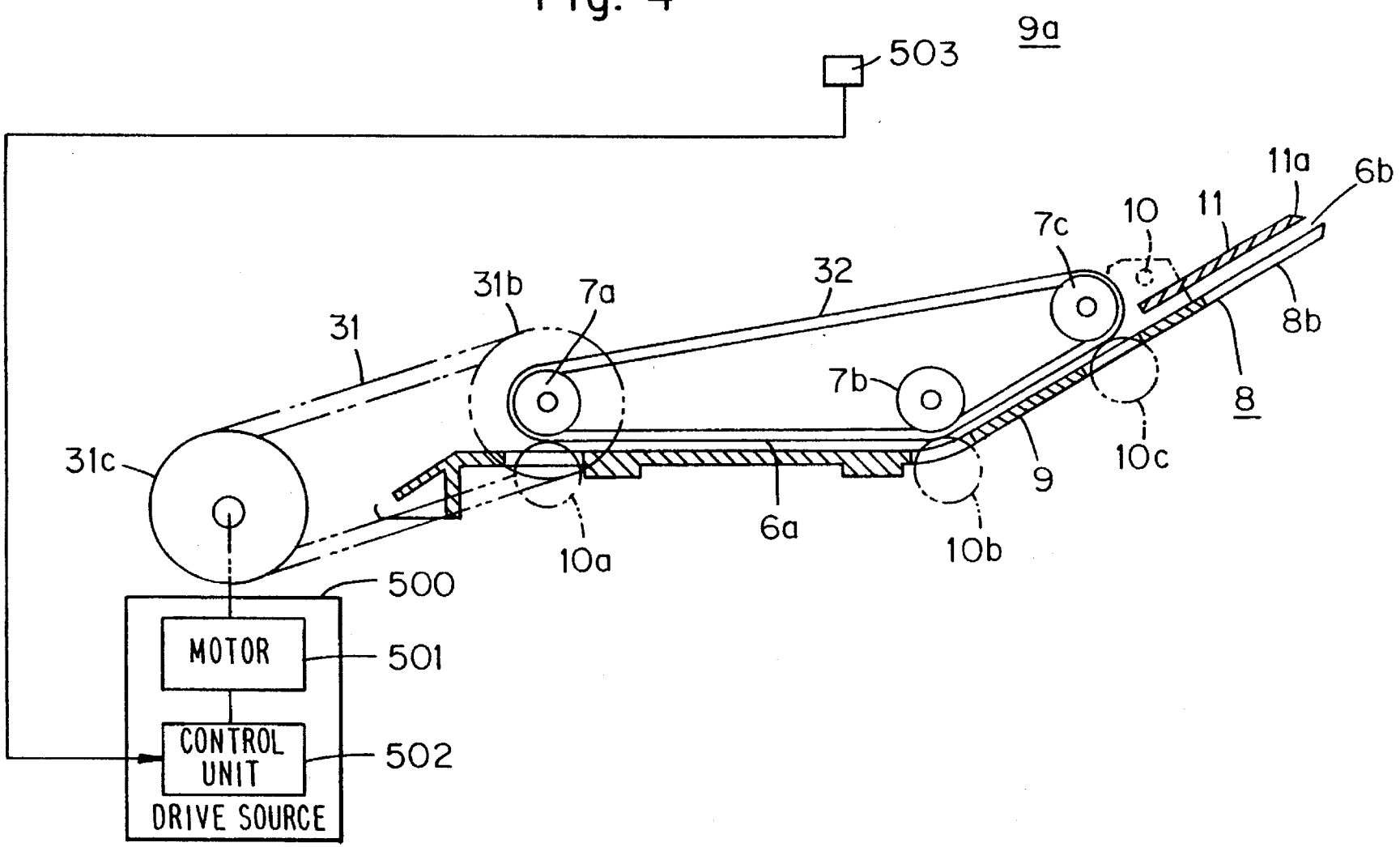
FIG. 4 is a sectional view showing part of the merging unit which constitutes the above mentioned embodiment.

The merging unit 9*a* includes a passage member 6 and a passage frame 9 as shown in FIGS. 1 and 4. The member 6 and the passage frame 9 are usually disposed in an opposing relationship so that a bank note passage 6*a* is formed therebetween. The passage member 6 and the passage frame 9 are bent toward the transporting belt 2. The passage 6*a* includes a portion which is in parallel with the transporting belt 2 and a portion which is slanted toward the transporting belt 2. The passage 6*a* has a length which is equal to at least the length of one bank note. This enables the bank note to be temporarily brought into a standby position.

Roller type transporting members 7*a*, 7*b* and 7*c* are mounted on the passage member 6 in three positions such as the upstream side, the curved portion and the downstream side thereof. A drive belt 32 is wound on three roller type transporting members 7*a*, 7*b* and 7*c* as shown in FIG. 4. The roller type transporting member 7*a* is linked with a pulley 31*b* via the same shaft. The pulley 31*b* is linked with the pulley 31*c* via a belt 31 so that the pulley 31*b* is driven to rotate by the belt 31. In association with this rotation, the other roller type transporting members 7*b* and 7*c* are driven to rotate by the drive belt 32. The pulley 31*c* is driven to rotate by a drive source 500.

The drive source 500 includes a motor 501 for driving the pulley 31*c*, a control unit 502 for controlling the rotation of the motor 501 and a sensor 503 for detecting the conditions of the bank notes transported by the transporting belt 2. In other words, the sensor 503 detects whether or not there is a bank note which is transported in the vicinity of the position which is in front of the merging unit 9*a* on the drive belt 2 when another bank note from the transporting belt 2 reaches the transporting belt 2. The control unit 502 controls energization of the motor 501 depending upon the detection result of the sensor 503. This drives the roller type transporting members 7*a*, 7*b* and 7*c*. That is, the control unit 502 temporarily keeps a bank note ejected from the bank note identifying unit 5 on and drives the roller type transporting members 7*a*, 7*b* and 7*c* by energizing the motor 501 when the sensor detects that no bank note is in the vicinity of the leading bank note.

The passage member 6 is provided with a guide strip 11 for guiding the bank notes on the front end and downstream side thereof. The guide strip 11 has a width which is substantially equal to that of the transporting belt 2 and is provided in the same positional relationship as the belt 2. The guide strip 11 is disposed in such a manner that it is slanted and has the front end 11*a* which is positioned within the opening of the accepting slot 3 of the guide 1. The guide strip 11 is tapered at the front end 11*a* thereof so that the bank notes transported in the guide 1 are not jammed.

The passage frame 9 is provided with roller type transporting members 10*a*, 10*b*, 10*c* in positions corresponding to the three roller type transporting members 7*a*, 7*b* and 7*c*, respectively. Two guide strips 8*a* and 8*b* are secured to the passage frame 9 on the front end and the downstream side thereof. The two guide strips 8*a* and 8*b* are provided so that the spacing therebetween is larger than the width of the transporting belt 2. A bank note passage is defined between two guide strips 8*a*, 8*b* and the guide strip 11. This passage opens within the accepting slot 3 at the front end slot 6*b* thereof.

The passage frame 9 has a pivot shaft 10 at the base ends of the guide strips 8*a* and 8*b*. The passage frame 9 is mounted so that it is pivotal around the pivot shaft 10 as represented by a two dot chain line in FIG. 3. When the frame 9 is in a position represented by the two dot chain line, the guide strips 8*a* and 8*b* sandwich the guide strip 11 and the transporting belt 2 therebetween and are moved into the accepting slot 3. In other words, the guide strips 8*a*, 8*b* and 11 are in such a dimensional and positional relationship that they do not structurally interfere with each other.

When a game player inserts bank notes into the bank note inserting slot 4*a* as a game fee in such an arrangement, the bank notes are accepted and identification as to whether the bank notes are genuine or fake is made by the bank note identifying unit 5. If the bank note is genuine, it will be ejected into the passage 6*a*. The drive source 500 drives the roller type transporting members 7*a*, 7*b* and 7*c* to accept the bank notes from the bank note identifying unit 5 and causes the bank note to temporarily standby. When the sensor 503 detects that no bank note is transported in front of the accepting slot 3 for the drive belt 2, the control unit 502 of the drive source 500 drives the roller type transporting members 7*a*, 7*b* and 7*c* by the motor 501 to feed the bank note to the passage between the guide strips 8*a*, 8*b* and the guide strip 11 and then to feed it to the transporting belt 2 via the accepting slot 3.

Since the bank note transporting mechanism is provided independently of the bank note identifying unit 5 and the merging unit 9*a* in the this embodiment, the next bank note can be accepted into the identifying unit 5 while a bank note is in the standby position in the merging unit 9*a*. Inserting of bank notes is possible even if the previously inserted bank note is in the standby position when a game player pays fees for renting the game media. Therefore, the game player does not have to wait for acceptance of the bank note.

Jamming of the bank notes is liable to occur in this portion. In the event of jamming, the covering member 18 is opened and the passage frame 9 is pivoted around the pivot shaft 10 to a position represented by the phantom line (two dot chain line) in FIG. 3. This pivotal movement is manually carried out by a service man.

When the passage frame 9 is pivoted, the guide strips 8*a*, 8*b* mounted at the front end of the passage frame 9 are moved into the inner side of the accepting slot 3. At this time, the guide strips 8*a*, 8*b* are not brought into contact with the transporting belt 2 and the other guide strip 11 since the spacing between the guide strips 8*a* and 8*b* is wider than those of the transporting belt 2 and the other guide strip 11 and they are provided on the outer sides thereof. Accordingly, the passage frame 9 can be pivoted so that the passage 6*a* and the front end slot 6*b* are widely opened toward the front side. Therefore, jammed bank notes can be quickly and easily removed. In the event of failure, repair can be quickly and easily carried out.

As mentioned above, in accordance with the embodiment of the present invention, there is provided a mechanism for merging the bank notes from the game media lending machines in a position along the length of the bank note transporting path comprising the guide 1 and the transporting belt 2. In accordance with the embodiment of the present invention, there is provided a mechanism for opening the passage of the bank notes and the merging point by pivoting the passage frame constituting a part of the bank note passage toward the front side.

This enables countermeasures for the jamming of the bank notes be quickly and easily taken.

Although the present invention has been described and illustrated in detail, it should be clearly understood that the same is by way of illustration and example only and is not to be taken by way of limitation, the spirit and scope of the present invention being limited only by the terms of the appended claims.

What is claimed is:

1. A bank note transporting apparatus for transporting externally inserted bank notes, which is provided in a game machine island in which a plurality of game machines and a plurality of game media lending machines for lending game media used for playing games are disposed, comprising:

main transporting means provided within the island for transporting bank notes to a destination position; and introducing means disposed in at least one position along the length of said main transporting means for merging bank notes externally inserted into the island to said main transporting means;

said main transporting means including an accepting slot for accepting the bank notes from said introducing means;

said introducing means including a bank note inserting unit into which the bank notes are externally inserted and a merging unit for guiding and transporting the inserted bank notes to said accepting slot;

said merging unit including a passage member for transporting the bank notes and a passage frame which is pivotally mounted on one end of the passage member; and said passage frame being mounted on said passage member in such a manner that said passage frame is disposed in parallel with said passage member to form a transporting passage therebetween when said introducing means is driven and is separated from the transporting passage defining face of said transporting member when said passage frame is pivoted about a pivot shaft perpendicular to a transporting direction of the bank notes and parallel to surfaces of the bank notes.

2. A bank note transporting apparatus as defined in claim 1 in which said main transporting means includes a first transporting belt for transporting bank notes, a guide for guiding the transported bank notes and a second transporting belt between the first transporting belt and the guide for transporting the bank notes along the guide, said guide having said accepting slot.

3. A bank note transporting apparatus as defined in claim 2 in which said merging unit includes guide strips at respective front ends of the passage member and the passage frame for guiding bank notes to an accepting slot of the main transporting means.

4. A bank note transporting apparatus as defined in claim 3 in which further includes a pivot shaft provided in the vicinity of base end portions of said guide strips, said passage frame being pivotally linked with said passage member via the pivot shaft.

5. A bank note transporting apparatus as defined in claim 4 in which said guide strips have respective front ends which are inserted into said accepting slot.

6. A bank note transporting apparatus as defined in claim 5 in which said guide strips are disposed to be slanted toward said guide.

7. A bank note transporting apparatus as defined in claim 6 in which said guide strips on said passage member and on the passage frame have such a dimensional and positional relationship that they do not structurally interfere with each other when the passage frame is pivoted.

8. A bank note transporting apparatus as defined in claim 2 in which said transporting path further includes a bank note identifying unit between the bank note inserting unit and the merging unit for determining whether the bank note is genuine or fake.

9. A bank note transporting apparatus for transporting externally inserted bank notes, which is provided in a game machine island in which a plurality of game machines and a plurality of game media lending machines for lending game media used for playing games are disposed, said bank note transporting apparatus comprising:

a main transporting pathway provided within the island for transporting bank notes to a destination position, a first transporting belt for transporting bank notes, a guide for guiding the transported bank notes and a second transporting belt which forms a transporting pathway between the first transporting belt and the guide for transporting the bank notes along the guide, said guide having said accepting slot; and an introducing pathway disposed in at least one position along the length of said main transporting pathway for merging bank notes externally inserted into the island to said main transporting pathway;

said main transporting pathway including an accepting slot for accepting the bank notes from said introducing pathway, said introducing pathway including a bank note inserting unit into which the bank notes are externally inserted and a merging unit for guiding and transporting the inserted bank notes to said accepting slot, said merging unit including a passage member for transporting the bank notes and a passage frame which is pivotally mounted on one end of the passage member, said passage frame being mounted on said passage member in such a manner that said passage frame is disposed in parallel with said passage member to form a transporting passage therebetween when said introducing pathway is driven and is separated from the transporting passage defining face of said transporting member when said passage frame is pivoted, said merging unit also including guide strips at the front ends of the passage member and guide strips on the passage frame for cooperatively guiding bank notes to an accepting slot of the main transporting pathway and a pivot shaft provided in the vicinity of respective base end portions of said guide strips, said passage frame being pivotally linked with said passage member via the pivot shaft, said guide strips having respective front ends which are inserted into said accepting slot and being disposed so that they are slanted toward said guide, said guide strips on said passage member and said guide strips on the passage frame having a dimensional and positional relationship such that they do not structurally interfere with each other when the passage frame is pivoted, wherein two guide strips on the side of the passage frame are provided with a spacing which is larger than the width of said transporting belt and the guide strip on the passage member is provided in such a positional and dimensional relationship with respect to the guide strips on the passage frame that the guide strip on the passage member can be sandwiched between the two guide strips on the side of the passage frame.

10. A bank note transporting apparatus as defined in claim 9 in which the transporting belt transports the bank notes which are in an erected position.

11. A bank note transporting apparatus as defined in claim 10 in which said accepting slot is formed wider than the lateral width of the transporting belt.

12. A bank note transporting apparatus as defined in claim 11 in which the merging unit includes transporting members for transporting bank notes and a drive source for driving the transporting members and accepts the bank notes from the bank note identifying unit for feeding them to the main transporting path via the accepting slot.

13. A bank note transporting apparatus as defined in claim 12 in which said drive source comprises a motor for driving the transporting members, a control unit for controlling energization of the motor and a sensor for detecting the presence or absence of a bank note in the vicinity of the front of the accepting slot where said merging unit is disposed, said control unit being adapted to temporarily stop the bank note when the bank note is accepted from the bank note identifying unit and to feed out the bank note via the accepting slot when said sensor detects that no bank note is transported in the vicinity of the front of the accepting slot.

14. A bank note transporting apparatus as defined in claim 13 in which a game machine island includes a unit supporting frame which supports one or more game machines and one or more game media lending machines as one unit, a plurality of unit supporting frames being continuously arranged to form one game machine island.

15. A bank note transporting apparatus as defined in claim 14 in which said main transporting path includes one transporting belt for each unit.

16. A bank note transporting apparatus as defined in claim 9 in which said transporting path further includes a bank note identifying unit between the bank note inserting unit and the merging unit for determining whether the bank note is genuine or fake.

* * * * *